US005210366A

United States Patent [19]

Sykes, Jr.

[11] Patent Number: 5,210,366

[45] Date of Patent: May 11, 1993

[54] METHOD AND DEVICE FOR DETECTING AND SEPARATING VOICES IN A COMPLEX MUSICAL COMPOSITION

[76] Inventor: Richard O. Sykes, Jr., 145 E. 2nd St., New York, N.Y. 10009

[21] Appl. No.: 712,516

[22] Filed: Jun. 10, 1991

[51] Int. Cl.[5] ..... G10H 1/12; G10H 3/18

[52] U.S. Cl. ..... 84/616; 84/627; 84/654; 84/DIG. 11

[58] Field of Search ..... 84/627, 663, 625, 604, 84/622, 632, 615, 616, DIG. 11, 454, 462, 672, 673, 675, 681; 381/43, 46, 47; 340/566

[56] References Cited

U.S. PATENT DOCUMENTS

| | | | |
|---|---|---|---|
| Re. 33,739 | 11/1991 | Takashima et al. | 84/616 |
| 4,377,961 | 3/1983 | Bode | 84/454 |
| 4,627,323 | 12/1986 | Gold | 84/616 |
| 4,688,464 | 8/1987 | Gibson et al. | 84/454 |
| 4,895,060 | 1/1990 | Matsumoto | 84/616 |
| 4,905,562 | 3/1990 | Beacham et al. | 84/615 |
| 4,918,730 | 4/1990 | Schulze | 381/43 |
| 4,965,552 | 10/1990 | Price et al. | 340/566 |
| 4,984,496 | 1/1991 | Beacham et al. | 84/625 |
| 5,070,754 | 12/1991 | Adamson | 84/454 |
| 5,092,216 | 3/1992 | Wadhams | 84/602 |
| 5,142,961 | 9/1992 | Paroutaud | 84/645 |

*Primary Examiner*—William M. Shoop, Jr.

*Assistant Examiner*—H. Kim

*Attorney, Agent, or Firm*—Abdallah & Muckelroy

[57] ABSTRACT

A system and method for detecting, separating and recording the individual voices in a musical composition performed by a plurality of instruments. The electrical waveform signal for the multi-voiced musical composition is fed to a waveform signal converter to convert the waveform signal to a frequency spectrum representation. The frequency spectrum representation is fed to a frequency spectrum comparator where it is compared to predetermined steady-state frequency spectrum representations for a particular musical instrument. Upon detecting the presence of a frequency spectrum representation corresponding to a predetermined steady-state frequency spectrum representation, the detected frequency spectrum representation and measured growth and decay frequency spectrum representations are fed to a waveform envelope comparator and compared to predetermined waveform envelopes, i.e. frequency spectrum representations during the growth, steady-state and decay periods of the waveform signal. Upon detecting the presence of a waveform envelope corresponding to a predetermined waveform envelope, the steady-state and transient properties of the detected frequency spectrum representation are recorded and converted to an electrical waveform signal for output as music data for an individual voice.

52 Claims, 6 Drawing Sheets 0.04 SECOND 0.6 SECOND 1.4 SECONDS

METHOD AND DEVICE FOR DETECTING AND SEPARATING VOICES IN A COMPLEX MUSICAL COMPOSITION

BACKGROUND OF THE INVENTION

The present invention generally relates to sound signal analyzers. More specifically, the present invention relates to a "front end" sound signal analyzer for detecting and separating individual voices in a complex musical composition.

The term "complex musical composition" as used in the present disclosure should be understood to mean a multi-voiced musical composition, i.e. musical sounds simultaneously played by more than one instrument. The "voices" or sounds of the instruments may be generated by a natural or conventional instrument, including the human voice.

Devices for recognizing aspects of sound waves, for example the fundamental frequency component of a complex sound wave, are disclosed in the prior art. These prior art devices are generally limited to the analysis of a single instrument or vocalist. To the Applicant's knowledge no prior art device discloses means to detect and separate the sounds of an individual instrument from the sounds of a plurality of instruments simultaneously played.

U.S. Pat. No. 4,457,203 to Schoenberg et al. discloses a sound signal automatic detection system which detects and displays the fundamental frequency of notes played on a single instrument. The fundamental frequency is determined by an alternate positive peak voltage and negative peak voltage detector circuit which analyzes the first major positive going peak voltage and the first major negative going peak voltage exceeding threshold voltage values. U.S. Pat. No. 4,377,961 to Bode discloses a fundamental frequency extractor including separate extractors of successively wider frequency bands and having frequency intervals equal to or less than an octave. A method and apparatus for classifying audio signals is disclosed in U.S. Pat. No. 4,542,525 to Hopf which converts the null transitions of an audio frequency signal into two binary pulse sequences which are compared to predetermined pulse lengths and separate pause detection operations logic circuits. U.S. Pat. No. 3,926,088 to Davis et al. discloses an electro-mechanical device to translate movements of the sound producing means of a musical instrument into musical data. A "frequency follower" is shown in U.S. Pat. No. 4,313,361 to Deutsch.

A tone generating device which extracts pitches from input waveform signals and defines the frequency of the generated tone by comparing the extracted pitch to a range of predetermined musical interval difference is shown in U.S. Pat. No. 4,895,060 to Matsumoto. U.S. Pat. No. 4,399,731 to Aoki discloses a music composition device which randomly extracts stored pitch data in accordance with predetermined music conditions. U.S. Pat. No. 4,909,126 to Skinn et al. discloses a mechanical tuning system for a musical instrument.

The foregoing prior art sound signal analyzers do not meet the terms of the present invention which provides novel means to detect, separate and record the sounds of individual instruments in a "complex musical composition." Thus, by utilizing the present invention the viola parts, for example, in a complex musical composition played by a string quartet may be extracted and recorded as musical data.

Musical instruments including the human voice produce fundamental frequencies and overtones (harmonics) of fundamental frequencies. The same note played by different instruments sounds differently because of the overtone structure or timbre of the sound. Overtones add fullness to a musical sound and timbre is one characteristic that can identify the instrument producing the sound.

A sound wave may be represented by a complex wave composed of the fundamental and harmonics or overtones in the proper amplitude and phase relations. The sound wave can therefore be expressed mathematically. Graphically, the structure of a sound wave produced by a musical instrument can be represented by a spectrum graph or frequency spectrum. A frequency spectrum is a representation of the relative amplitudes of the fundamental and harmonics (overtones) as a function of frequency. Frequency spectrums can be used to depict the timbre of the sounds produced by a musical instrument and therefore can be utilized to distinguish different instruments in a complex musical composition.

A frequency spectrum is an instantaneous-acoustical spectrum generally measured during a steady-state period of a musical sound. Musical sounds from different instruments also have characteristic transient properties. The transient properties define a waveform envelope including growth, steady-state and decay characteristics. Reference is made to the excellent work *Musical Engineering* by Harry F. Olson (McGraw Hill, 1952) which details the formulation of frequency spectrums and is incorporated herein by reference.

It should also be readily understood by those skilled in the art that musical compositions are written within the framework of specific musical keys. Thus, notes unique to the key in which a musical composition is written have a much higher probability of being sounded than notes not associated with that key. As a result, the key in which a musical composition is written car be utilized to further distinguish the several instruments in a complex musical composition.

SUMMARY OF THE INVENTION

The present invention is a voice detection and separation system that includes a sound signal analyzer for automatically detecting, separating and recording the individual voices in a complex musical composition. Live or recorded sounds of a complex musical composition are converted into the corresponding electrical waveform signal by means of a sound wave converter. The waveform signal is amplified and supplied to the aforementioned sound signal analyzer. The sound signal analyzer includes a waveform signal converter which converts the waveform signal into frequency spectrum representations for the complex musical composition. The frequency spectrum representations for the complex musical composition are supplied to at least one pre-programmed frequency spectrum comparator. A frequency spectrum comparator may be provided for a specific instrument or for each musical instrument in the complex musical composition. The frequency spectrum comparator detects, according to instantaneous spectrum characteristics, notes of the musical sounds depicted by frequency spectrum representations by comparing pre-determined and pre-programmed, steady-state frequency spectrum representations with the frequency spectrum representations for the complex musical composition. The pre-programmed, steady-state frequency spectrum representations correspond to notes that can be played by the instrument for which the comparator is programmed. The output from frequency spectrum comparator includes frequency spectrum representations during short intervals of time in the growth, steady-state and decay periods thereby defining a waveform envelope for detected notes. The waveform envelope outputted from the frequency spectrum comparator is supplied to a pre-programmed waveform envelope comparator to analyze the transient properties of the waveform envelope. Waveform envelope comparator compares the waveform envelope outputted from the frequency spectrum comparator to pre-determined and pre-programmed waveform envelopes corresponding to the notes that can be played by the instrument for which the comparator is programmed. Waveform envelopes within a range of the pre-programmed waveform envelopes in the waveform envelope comparator are gated by the waveform envelope comparator to a frequency spectrum recorder. The detected instantaneous frequency spectrum and its transient properties are recorded, converted to an electrical waveform signal and output as music data. A further embodiment of the present invention includes a key comparator for higher order analysis of the complex musical composition.

An object of the present invention is to provide means to detect and separate voices in a complex musical composition.

Another object of this invention is to provide means to automatically and separably record in a readable form the voices of individual instruments in a complex musical composition.

A further object of the present invention is to provide an improved means for teaching music and music composition by manipulation of music data in a complex musical composition.

It is also an object of this invention &o provide means to detect and separate unique musical events that do not correspond to a specific musical key or note.

These and other objectives and advantages of the present invention will be apparent to those skilled in the art from the following description of a preferred embodiment, claims and appended drawings.

DESCRIPTION OF PREFERRED EMBODIMENTS

Figure 1:
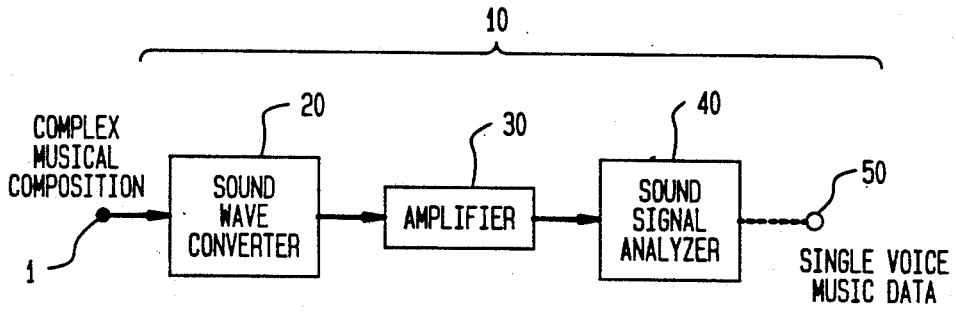
FIG. 1 is a block diagram of a voice detection and separation system in accordance with the teachings of the present invention.

FIG. 1 is a block diagram illustrating the general components of a voice detection and separation system 10 constructed in accordance with the teachings of the present invention. The sound waves of a complex musical composition 1, for example a live performance by a string quartet, are converted into an electrical waveform signal by means of a sound wave converter 20. Sound wave converter 20 may comprise any conventional, commercially-available microphone for picking up sound waves and converting the sound waves into an electrical signal having a frequency corresponding to the frequency of the sound wave. It should be understood by those skilled in the art that the complex musical composition 1 may also be stored on a cassette tape, a laser disk recording, or other storage medium without departing from the invention of the present disclosure. Therefore, more generally, sound wave converter 20 comprises any suitable means known in the art to produce from a live or stored complex musical composition 1 an electrical waveform signal having a frequency corresponding to the frequency of the audible sound wave of the complex musical composition 1.

The electrical waveform signal outputted from sound wave converter 20 is preferably amplified by means of amplifier 30. The amplified electrical waveform signal is supplied to a sound signal analyzer 40. Sound signal analyzer 40 outputs single-voice music data 50, i.e. data representing the music played by a single instrument in the complex musical composition 1.

The novelty of the voice detection and separation system 10 of the present invention resides primarily in the sound signal analyzer 40. The construction and operation of sound signal analyzer 40 are more fully described hereinafter. In general, sound signal analyzer 40 comprises means to detect a single-voice electrical waveform signal, i.e. an electrical waveform signal depicting a single, particular instrument; means to separate the detected, single-voice waveform signal from the complex waveform signal, i.e. the waveform signal depicting the complex musical composition 1; and means to record the separated, single-voice waveform signal for output as music data 50.

Figure 2:
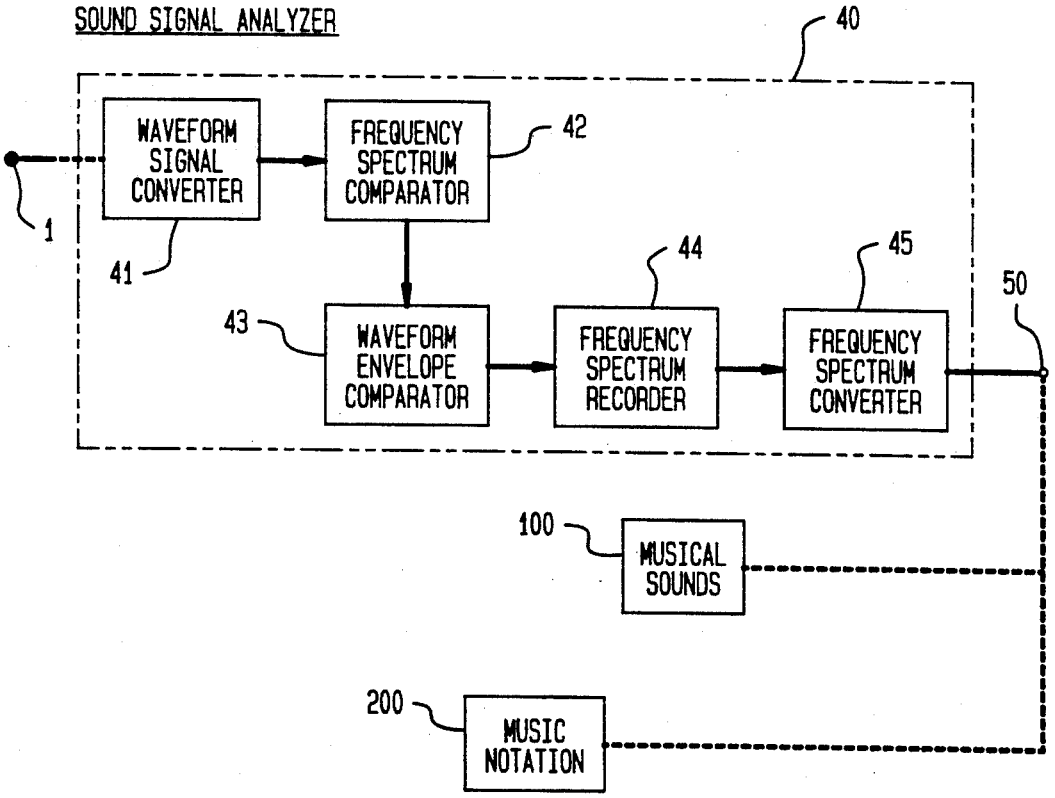
FIG. 2 is a block diagram of the sound signal analyzer of the present invention. 1

FIG. 2 illustrates in a block diagram a first preferred embodiment of a sound signal analyzer 40 suitable for use in the voice detection and separation system 10 of the present invention. First sound signal analyzer 40 operates on the basic principal that a single voice in a complex musical composition 1 can be distinguished by the instantaneous and transient properties of frequency spectrum representations for the particular voice. First sound signal analyzer 40 in a first step converts the electrical waveform signal for the complex musical composition 1 to a frequency spectrum representation for the complex musical composition 1 by means of a waveform signal converter 41. Waveform signal converter 41 is a device, for example a scanning heterodyne type of instrument, which automatically separates the fundamental and overtone frequency components of the complex electrical waveform signal and simultaneously measures their frequency and amplitude. The complex frequency spectrum representation outputted from the waveform signal converter 41 is supplied to a frequency spectrum comparator 42.

Frequency spectrum comparator 42 compares the complex frequency spectrum representation from waveform signal converter 41 to predetermined steady state, single-voice frequency spectrum representations corresponding to the notes capable of being produced by a particular musical instrument. The predetermined, single-voice frequency spectrum representations are stored in the frequency spectrum comparator 42 on a memory chip, for example. The various notes that can be played on a musical instrument have distinct tonal structures that can be depicted as respective steady-state frequency spectrum representations. Thus it should be understood that a frequency spectrum comparator 42 in accordance with the present invention will have a plurality of predetermined steady-state frequency spectrum representations stored in its memory corresponding to the various distinct tonal structures capable of being produced by the particular musical instrument for which the frequency spectrum comparator 42 is programmed. Thus, if it is desired to detect and separate the viola parts in a complex musical composition 1 produced by a string quartet, for example, the various frequency spectrum representations for the notes capable of being produced by a viola are stored on a memory chip in frequency spectrum comparator 42. To detect the viola parts in the complex musical composition 1 the complex frequency spectrum representation from waveform signal converter 41 is compared to the single-voice frequency spectrum representations for the viola stored in the memory of the frequency spectrum comparator 42. The frequency spectrum representation detected by the frequency spectrum comparator 42 is a measure of the instantaneous frequency spectrum during a steady-state period. If the inputted complex frequency spectrum representation and a stored single-voice frequency spectrum representation match, the matched steady-state frequency spectrum representation and frequency spectrum representations in the growth and decay periods of the note depicted by the detected steady-state frequency spectrum representation are outputted from the frequency spectrum comparator 42. The respective growth, steady-state and decay frequency spectrum representations outputted from the frequency spectrum comparator 42 are then supplied to a waveform envelope comparator 43. Waveform envelope comparator 43 as hereinafter described in greater detail operates in a manner similar to the operation of frequency spectrum comparator 42, the waveform envelope comparator 43 being responsive to the transient properties of a waveform envelope for a particular note.

The frequency spectrum representation for a complex musical composition 1 generally comprises a superpositioning of the respective single-voice frequency spectrum representations for the individual musical instruments. Thus, in a complex frequency spectrum representation the fundamental and/or harmonics of one instrument may be combined with those of other instruments at various frequencies. To distinguish such a combination of steady-state frequency spectrum representations from a single-voice, steady-state frequency spectrum representation, frequency spectrum comparator 42 detects the minimal presence of a stored, single-voice frequency spectrum representation. That is, the frequency spectrum comparator 42 recognizes a "match" when a predetermined single voice, steady-state frequency spectrum representation is "at least" present in the complex frequency spectrum representation. Upon detecting a predetermined single-voice, steady-state frequency spectrum representation in the complex frequency spectrum representation, frequency spectrum comparator 42 measures frequency spectrum representations in the growth and decay periods for the particular note depicted by the detected single-voice, steady-state frequency spectrum representation. That is, sequential complex frequency spectrum representations sufficient to include growth and decay periods for the notes of the particular instrument are gathered in an accumulating memory of the frequency spectrum comparator 42 and the measuring of growth and decay complex frequency spectrum representations is activated by the occurrence of "matching" steady-state, single-voice frequency spectrum representations. The time sequencing for the measure of frequency spectrum representations in the growth and decay periods varies by instrument and by the particular note. The detected single-voice, steady-state frequency spectrum representation and the corresponding measured growth and decay frequency spectrum representations are outputted from the frequency spectrum comparator 42, defining a waveform envelope representation, and are supplied to the waveform envelope comparator 43.

In addition to steady-state characteristics of the tonal structure, the various notes that can be played on a musical instrument have distinct transient properties that can be depicted as respective waveform envelope representations. Waveform envelope comparator 43 compares the waveform envelope representation from frequency spectrum comparator 42 to predetermined waveform envelope representations corresponding to the notes capable of being produced by a particular musical instrument. Thus, waveform envelope comparator 43 serves as a secondary check of the note detection resulting from the operation of frequency spectrum comparator 42. The predetermined waveform envelope representations are stored in the waveform envelope comparator 43 on a memory chip, for example. It should be understood that a waveform envelope comparator 43 in accordance with the present invention will have a plurality of pre-determined waveform envelope representations stored in its memory corresponding to the various transient characteristics of notes capable of being played on a particular musical instrument. If the inputted waveform envelope representation from frequency spectrum comparator 42 and a waveform envelope representation stored in waveform envelope comparator 43 match, the frequency spectrum representations for the matched waveform envelope representation are outputted from the waveform envelope comparator 43. The measured frequency spectrum representations in the growth and decay periods of the detected steady-state frequency spectrum representation from frequency spectrum comparator 42 may include a superposition of frequency spectrum representations and therefore waveform envelope comparator 43 detects the minimal presence of growth and decay frequency spectrum representation. That is, waveform envelope comparator 43 recognizes a "match" when a predetermined waveform envelope representation is "at least" present in the waveform envelope representation outputted from the frequency spectrum comparator 42. The matched waveform envelope representation is outputted from waveform envelope comparator 43 and supplied to a frequency spectrum recorder 44.

Frequency spectrum recorder 44 records in a readable form the frequency spectrum representations depicting the waveform envelope representation outputted from waveform envelope comparator 43. A frequency spectrum converter 45 is connected to frequency spectrum recorder 44 and comprises means to automatically convert the recorded frequency spectrum representations for the growth, steady-state and decay periods of the detected note into an electrical waveform signal. The electrical waveform signal from frequency spectrum converter 45 is outputted as music data 50. The music data 50 may be audible musical sounds 100 of a single voice of the complex musical composition 1 or music notation 200 for the single voice. To output the music data 50 as musiçal sounds 100 suitable means are provided to produce audible sounds from an electrical waveform signal, for example an amplifier and speakers To output the music data 50 as music notation 200 suitable means are provided to translate an electrical waveform signal into a format suitable for printing or displaying the waveform signal as music notation, for example a data processing system.

Figure 3A:
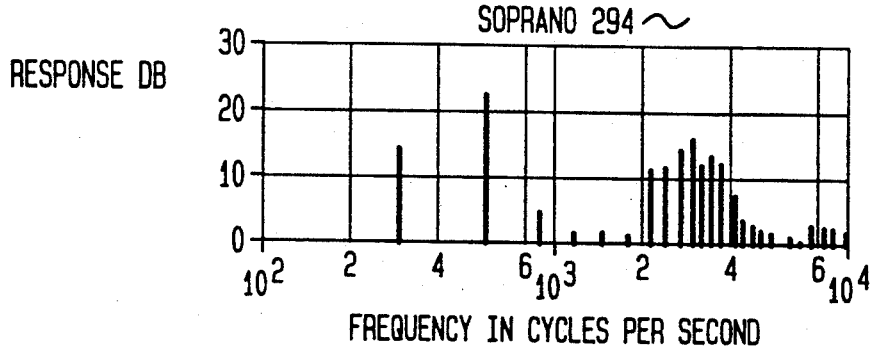
FIGS. 3A–3D illustrate steady-state frequency spectrum representations for respective single voices.
Figure 3B:
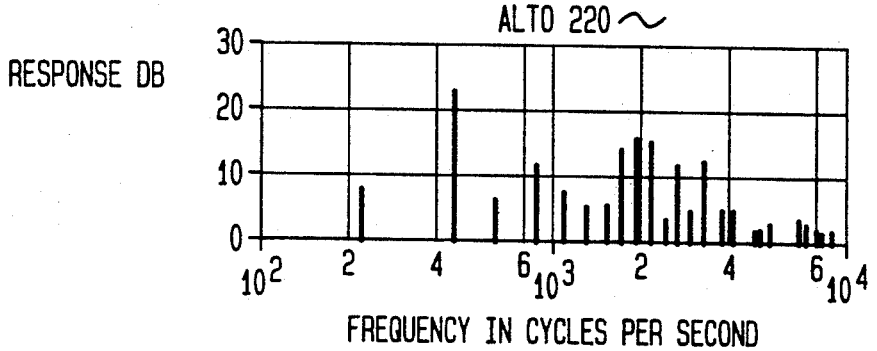
Figure 3C:
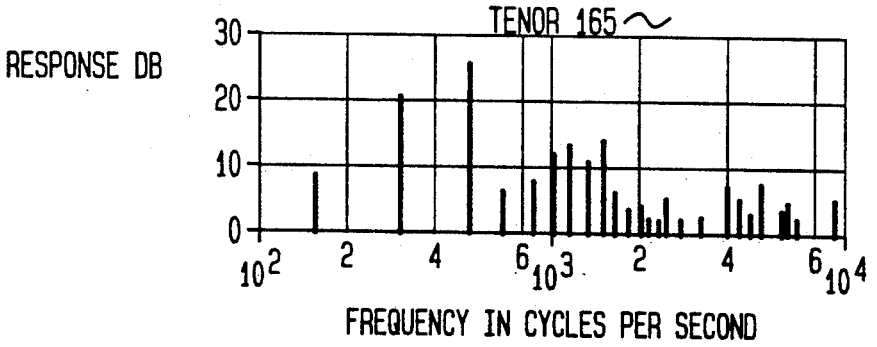
Figure 3D:
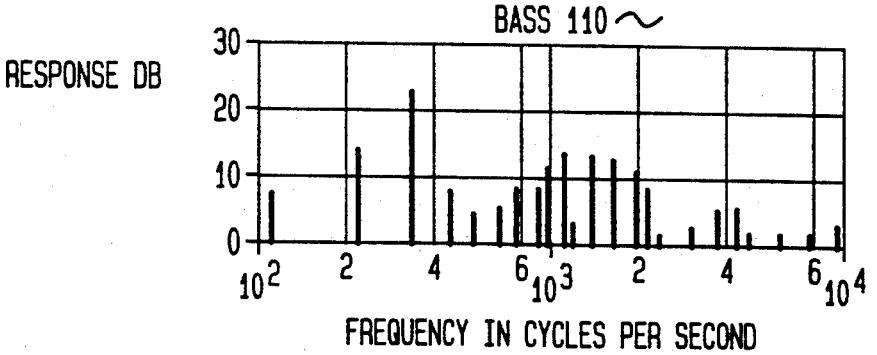
Figure 4A:
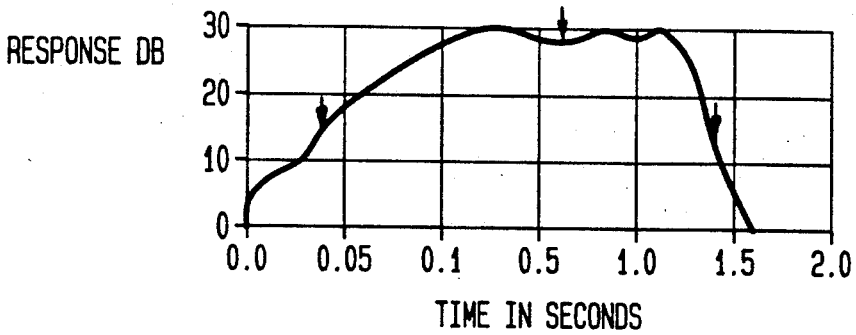
FIGS. 4A–4D illustrate single-voice frequency spectrum representations during the growth, steady-state and decay periods.
Figure 4B:
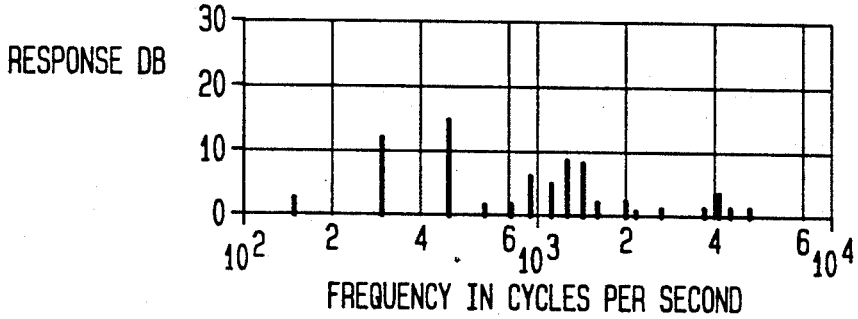
Figure 4C:
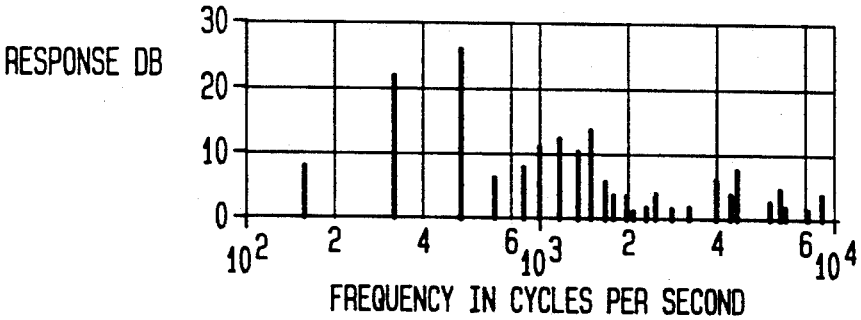
Figure 4D:
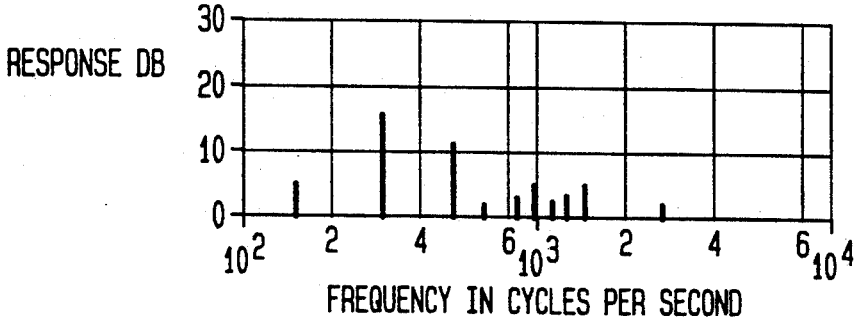

To illustrate the aforementioned steady-state and transient properties of a sound wave FIGS. 3A–3D and 4A–4D respectively show graphical depictions of steady-state and waveform envelope frequency spectrum representations. FIG. 3A illustrates the steady-state producing the vowel sound "ah." FIG. 3B illustrates the steady-state frequency spectrum rrepresentation for a soprano voice (f=294 dB) producing the vowel sound "ah." FIG. 3B illustrates the steady-state frequency spectrum representation for an alto voice (f=220 db) doing the same; FIG. 3C for a tenor voice (f=165 db); FIG. 3D for a base voice (f=110 db). The frequency spectrum representations in FIGS. 3A–3D depict the sound produced for a short interval of time during the steady-state period of the sound wave. FIG. 4A graphically illustrates the growth, steady-state and decay periods for a tenor voice producing the vowel sound "ah." FIGS. 4B–4D illustrate frequency spectrum representations in the respective growth, steady-state and decay periods of the tenor voice producing the vowel sound "ah" at the points marked by arrows in FIG. 4A.

Figure 5:
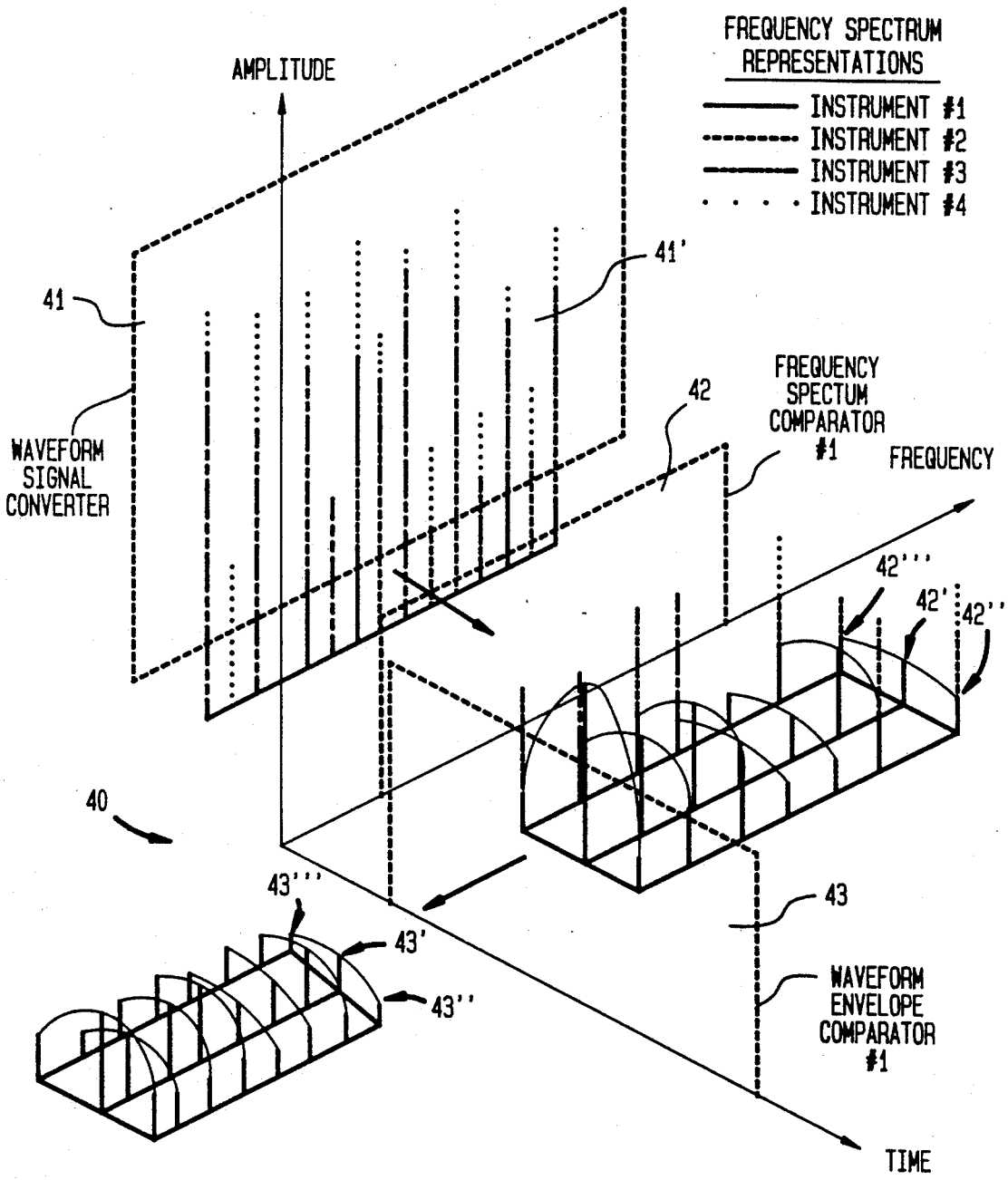
FIG. 5 is a graphical illustration of the sound signal analyzer of the present invention.

FIG. 5 graphically illustrates the mathematical relationships and operation of the first sound signal analyzer 40 of the present invention. First sound signal analyzer 40 generally operates by means of successive detection and separation of steady-state and transient characteristics of frequency spectrum representations for notes played by an instrument. The complex frequency spectrum representation 41' supplied from the waveform signal converter 41 and shown in FIG. 5 for a complex musical composition 1 consisting of four voices, generally comprises a superpositioning of the frequency spectrums for the individual instruments. It should be understood that a series of complex frequency spectrum representations 41' are sequentially supplied from waveform signal converter 41. Complex frequency spectrum representation 41' is supplied to a frequency spectrum comparator 42 pre-programmed for a particular instrument, for example Instrument #1. Frequency spectrum comparator 42 includes a temporary accumulating memory which collects a series of complex frequency spectrum representations 41' sufficient to cover the growth and decay periods of any notes that can be produced by Instrument #1, for example, as hereinafter described in greater detail. Upon the occurrence in the complex frequency spectrum representation 41' of a note capable of being produced by Instrument #1, frequency spectrum comparator 42 detects the steady state frequency spectrum representation 42' for that note and signals for the measurement of a growth frequency spectrum representation 42'' and a decay frequency spectrum representation 42''' corresponding to the detected steady-state frequency spectrum representation 42'. The detected steady state frequency spectrum representation 42' and the measured growth and decay frequency spectrum representations 42'' and 42''' are outputted from frequency spectrum comparator 42. As can be seen in FIG. 5, the measured frequency spectrum representations 42'' and 42''' comprise a superpositioning of frequency spectrum representations for the plurality of instruments. The detected frequency spectrum representation 42' and the measured frequency spectrum representations 42'' and 42''' are then supplied to a waveform envelope comparator 43 to further refine the detection and separation of a note for an individual instrument. Upon occurrence of a waveform envelope corresponding to the note depicted by the steady-state frequency spectrum representation 42', a growth frequency spectrum representation 43'', a steady state frequency spectrum representation 43' and a decay frequency spectrum representation 43''' are outputted from the waveform envelope comparator 43 thereby providing frequency spectrum representations of the instantaneous and transient properties of the detected note.

As previously noted, frequency spectrum comparator 42 includes an accumulating memory to initially and temporarily retain frequency spectrum representations over an interval of time sufficient to measure the growth and decay periods for respective notes, for example five seconds. Thereby when a steady-state frequency spectrum representation is detected the growth and decay periods of the detected note remain available for measure by the frequency spectrum comparator 42. In summary, the accumulating memory of frequency spectrum comparator 42 sequentially stores in temporary memory the frequency spectrum representations over a sufficient interval of time to include the growth, steady-state and decay periods for particular notes capable of being produced by a particular instrument. This time interval may vary for each note in each instrument. The temporarily-stored plurality of frequency spectrum representations are then analyzed for the presence of a frequency spectrum representation for specific notes of the instrument identified by comparison with pre-programmed frequency spectrum representations. Upon occurrence of a frequency spectrum representation that matches a pre-programmed frequency spectrum representation, signaling means detects and separates the pre-programmed frequency spectrum representation and respective frequency spectrum representations at appropriate time intervals before and after the detected frequency spectrum representations for measurements in the growth and decay periods. The three frequency spectrum representations for the growth, steady-state and decay periods are then outputted by the frequency spectrum comparator 42.

Figure 6:
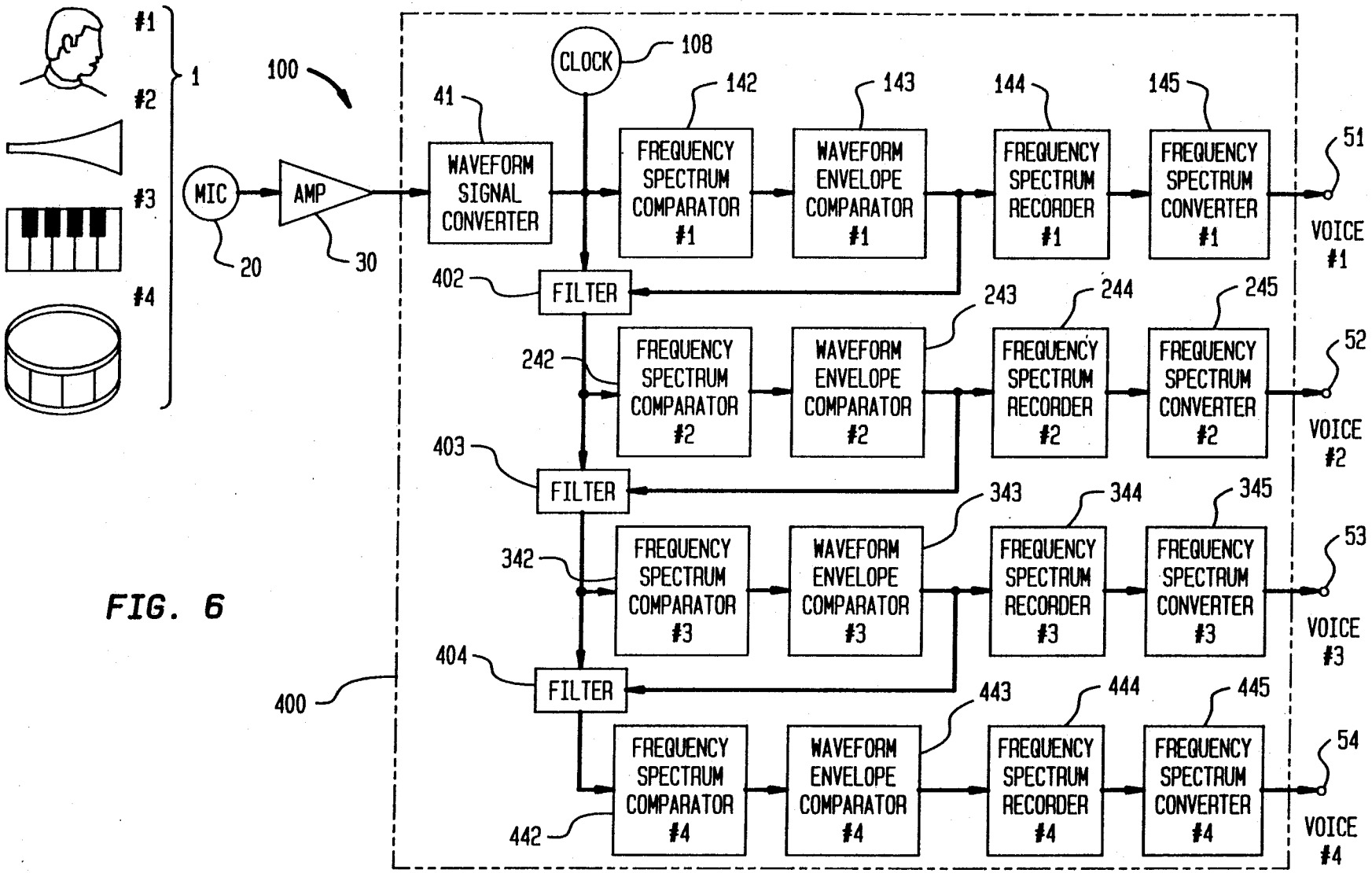
FIG. 6 is a block diagram of a second voice detection and separation system in accordance with the present invention.

FIG. 6 illustrates a second embodiment of a voice detection and separation system 100 constructed in accordance with the teachings of the present invention having a second preferred embodiment of a sound signal analyzer 400 that outputs single voice music data for a plurality of instruments. A complex musical composition 1 is produced by a plurality of voices, shown in FIG. 6 to comprise a human voice, Instrument #1, a horn, Instrument #2, a keyboard, Instrument #3 and a drum, Instrument #4. The complex musical composition 1 is fed to a microphone 20 and amplifier 30 for production of an electrical waveform signal as heretofore described. The waveform signal is converted to a frequency spectrum representation by means of waveform signal converter 41. Respective frequency spectrum comparators 142, 242, 342 and 442, waveform envelope comparators 143, 243, 343 and 443, frequency spectrum recorders 144, 244, 344 and 444, and frequency spectrum converters 145, 245, 345 and 445 are provided for the respective instruments. Clock means 401 is provided for sequentially cuing the supplying of frequency spectrum representations for the complex musical composition to the respective frequency spectrum comparators 142, 242, 342 and 442. Respective filtering means 402, 404 and 404 are disposed between respective waveform envelope comparators 143, 243, 343 and the successive frequency spectrum comparators 242, 342 and 442. The combination of clock means 401 and filtering means 402, 403 and 404 reduces the frequency spectrum representation supplied to successive frequency spectrum comparators 242, 342 and 442. Thus, a note detected and separated from the frequency spectrum representation for the complex musical composition 1 as being produced by Instrument #1 is filtered from the complex frequency spectrum representation prior to the now reduced complex frequency spectrum representation being supplied to the frequency spectrum comparator 342 for Instrument #2, and so on. Thereby the complex frequency spectrum representation is successively reduced to the extent of the foregoing detected frequency spectrum representations. Music data for the respective voices 51, 52, 53 and 54 is outputted from the respective frequency spectrum converters 145, 245, 345 and 445.

Figure 7:
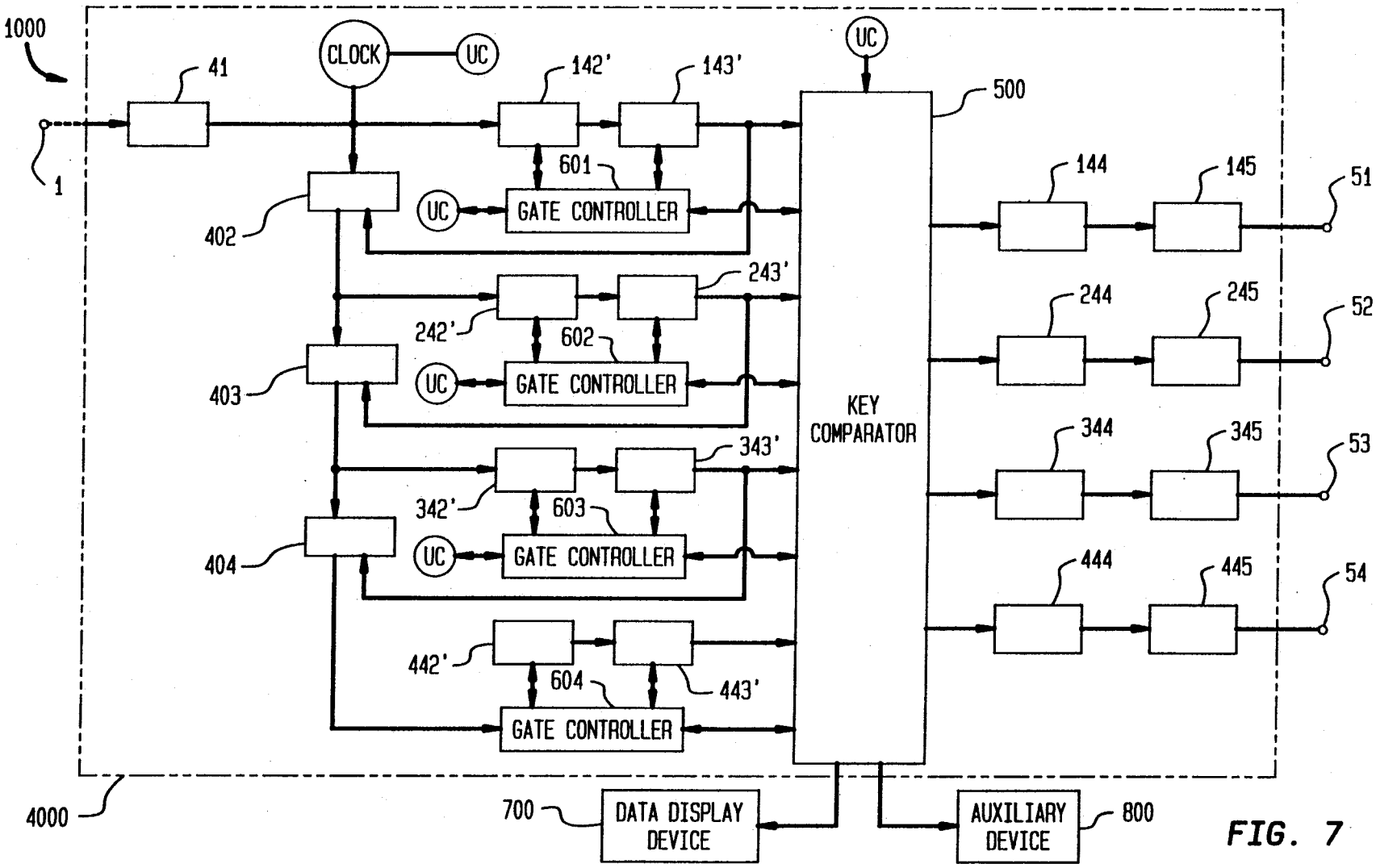
FIG. 7 is a block diagram of a third voice detection and separation system in accordance with the present invention.

As previously noted, the key in which a complex musical composition 1 is written can also be utilized to detect and separate notes of a single voice. FIG. 7 illustrates in a block diagram a third preferred embodiment of a voice detection and separation system 1000 which is constructed substantially similar to the second voice detection and separation system 100 illustrated in FIG. 6 with the exception that a third sound signal analyzer 4000 includes a key comparator 500 and associated plurality of gate controllers 601, 602, 603. Key comparator 500 may include active and/or passive operating characteristics, as hereinafter described in greater detail, to detect and separate single-voice notes and/or to modify the musical sounds of an instrument.

A basic principal for operation of key comparator 500 is that notes unique to the key in which the musical composition 1 is written have a much higher probability of being sounded than notes not associated with that key. Thus, notes likely to be produced by an instrument can be predicted based on the key of the musical composition 1. Music data for the complex musical composition 1 can be processed and built upon by the key comparator 500 to sequentially narrow the possible notes present in the musical composition. In this manner, key comparator 500 is "intelligent" and avoids repetitious operations to explore unnecessary possibilities. Music data in key comparator 500 can also be manipulated in various manners for teaching, tuning and filtering purposes.

Complex musical composition 1 is converted to an electrical waveform signal by means of sound wave converter 20 which is amplified by means of amplifier 30. The amplified electrical waveform signal is supplied to third sound signal analyzer 4000. Third sound signal analyzer 4000 includes a waveform converter 41 to convert the waveform signal to a series of frequency spectrum representations. Respective gated frequency spectrum comparators 142', 242', 342' and 442' and respective gated waveform envelope comparators 143', 243', 343' and 443' are provided for analysis of the steady-state and transient characteristics of frequency spectrum representations and waveform envelopes substantially as heretofore described. However, in the third sound signal analyzer 4000 the respective gated frequency spectrum comparators 142', 242', 342' and 442' and the respective gated waveform envelope comparators 143', 243', 343' and 443' communicate with key comparator 500 via respective gate controllers 601, 602, 603 and 604 and the frequency spectrum representations and waveform envelopes passed by these components are influenced by key comparator 500.

Key comparator 500 is preferably a ROM integrated circuit or other suitable memory device which contains within its memory representations of all musical keys, for examples C major, C minor, C augmented, etc., and the notes associated with the respective keys. The ROM integrated circuit of key comparator 500 may also include "exotic" pentatonic and microtonal keys. A user-programmable memory and ROM override controller circuit may be included in key comparator 500 to permit the addition of custom keys and/or notes. A suitable algorithm disposed in an algorithm memory and necessary electronic components govern the desired operations of key comparator 500.

Key comparator 500 samples, on a timely basis via a temporary accumulating memory, music data from the gated waveform envelope comparators 143', 243', 343', 443' and compares this data to data stored in the memory of the integrated circuit and/or to data stored in the user-programmable memory. Thereby key comparator 500 can determine the key in which the musical composition 1 is written and thus the notes associated with that key. As a result , the probable future musical events are supplied to the respective gate controllers 601, 602, 603, 604 for use in detecting and separating steady-state frequency representations and waveform envelopes.

The length of sampling by the temporary accumulating memory of key comparator 500 need only be of a sufficient duration to determine the proper key of the musical composition 1. Therefore, the sample length will be longer initially as the key comparator 500 must analyze groups of notes to determine the key. After initial determination of the key, the sample lengths can be shortened since the key comparator 500 need only verify that the music data being received is still in the same key, and therefore need analyze only single notes rather than a group of notes. It should be obvious to one skilled in the art that the sampling process is repeated if the key changes.

By operation of key comparator 500 and the associated gate controllers 601, 602, 603, 604 the percentage of false detection by the respective frequency spectrum comparators 142', 242', 342' and 442' and the respective waveform envelope comparators 143', 243', 343' and 443' can be reduced due to the knowledge of probable future musical events. In practice, the measured frequency spectrum representations and waveform envelopes can vary widely from the stored frequency spectrum representations and waveform envelopes at any given moment in time. This is especially true if an instrument goes out of tune or is modified electronically by any of the commercially-available effects devices, for examples echo, "fuzz," phase shifters, etc. There are also unique musical events that are not associated with a note, for example pink noise sources such as cymbals. These non-note musical sounds may occupy a large part of the frequency spectrum representations for a given period of time. Key comparator 500 can facilitate detecting, separating and/or filtering of such musical events by identifying such events as not being associated with the key of the musical composition 1.

The respective gate controllers 601, 602, 603, 604 continually access data through two way interfaces with three sources: (1) the respective gated frequency spectrum comparators 142', 242', 342' and 442', (2) the respective gated waveform envelope comparators 143', 243', 343' and 443', and (3) the key comparator 500. The respective interfaces between a gated frequency spectrum comparator 142' and the gate controller 601, and between a gated waveform envelope comparator 143' and the gate controller 601, operate according to an accuracy variable responsive to the degree of correlation between the measured music data and the stored music data in the respective components. If the respective "matches" within the gated frequency spectrum comparator 142' and the gated waveform envelope comparator 143' is "poor," i.e. marginal but within the parameters of the accuracy variable, gate controller 601 accesses the probable future music data from key comparator 500 for additional comparison in making a final pass/fail decision.

Music data outputted from the gated waveform envelope comparators 143', 243', 343' and 443' is supplied via key comparator 500 to respective frequency spectrum recorders 144, 244, 344 and 444 and in turn to respective frequency spectrum converters 145, 245, 345 and 445 for output of single-voice data 51, 52, 53 and 54 for the respective instruments. Third sound signal analyzer 4000 also includes respective filtering means 402, 403 and 404 disposed between respective gated waveform envelope comparators 143', 243' and 343' and the successive gated frequency spectrum comparators 242', 342' and 442' and clock means 401 as heretofore described.

Third sound signal analyzer 400 alternatively can be instructed by an appropriate algorithm to detect and select frequency spectrum representations for an individual instrument by "shifting" the frequency spectrum representations stored in the respective gated frequency spectrum comparators 142', 242', 342' and 442'. If data matches in a gated frequency spectrum comparator 142', 242', 342' or 442' is "poor" over a selected period of time, the respective gate controller 601, 602, 603 or 604 can operate as a frequency spectrum shifter to "shift" stored frequency spectrum representations up or down, i.e. add or subtract a frequency spectrum representation from the stored music data, according to pre-established design criteria to test if the music data is out of tune, i.e. out of key. "Out of tune" musical composition 1 may result from the musical composition being tuned to accommodate a singer's voice which may be "off key" or from physical adjustments to a musical instrument, for example, a guitar being down-tuned by loosening the strings to increase sustain and ease of playing. If a better match is obtained by this "shifting" of stored data, gate controller 601, 602, 603 or 604 directs the comparison of "out of tune" music data in the gated frequency spectrum comparator 142', 242', 342' or 442' to music data stored in key comparator 500 to determine the key of the music data, if any. An "out of tune" condition may alternatively be corrected by modification of the frequencies of the music data supplied to the respective frequency spectrum converters 145, 245, 345 or 445. As should be understood by those skilled in the art gate controllers 601, 602, 603 and 604 can include the frequency spectrum shifting function in conjunction with the supplemental comparison function The key comparator 500 of third sound signal analyzer 4000 can also be used to modify the notes produced by a particular instrument by deciding if an "incorrect" note, i.e. an out-of-key or "out-of-instrument" note, has been produced and determining what aesthetically appealing, in-key, note is a suitable replacement. The incorrect music data may be supplied to a data display device 700 where it can be viewed for teaching purposes, or the incorrect music data may be supplied to an auxiliary device 800, for example a note transposing device which transposes, in real time, by means of a suitable algorithm, the incorrect note to a probable in key note. The transposed in key note can then be supplied to a frequency spectrum recorder 144, 244, 344, 444 and frequency spectrum converter 145, 245, 345, 445 for output as part of the single-voice music data 51, 52, 53, 54, or removed from the music data stream.

As can be seen from the foregoing, the third sound signal analyzer 4000 permits through appropriate algorithms various manipulations of the music data for the complex musical composition 1. The storage of keys and their associated notes in key comparator 500 broadly expands the utility of the third voice detection and separation system 1000. Based on the key of the musical composition 1, notes having a higher probability of being sounded are collected in an identifiable group. This music data, the key and the probable future notes associated with the key, can be sent to a data display device 700 or other auxiliary devices 800 ;s heretofore described. The display of a key and the associated probable future notes can be a valuable assistant for learning and understanding music. The music data output from key comparator 500 represents probable future musical events that are related to the music composition 1 being analyzed. Since any note sounded within the appropriate time and within the key of the musical composition 1 will sound aesthetically pleasing, the display of this music data on the data display device 700 permits selection of a variety of acceptable notes and note combinations for composing variations of the musical composition 1 being analyzed.

Subsets of the in-key notes of the key comparator 500 may be formed and output as music data for further analysis and/or consequential assignment to specific instruments. These subsets may be based in part upon the number of times a specific note within a key is sounded by an instrument within a particular period of time in the musical composition 1. Such note-instrument subsets can be processed by comparison of note sounding ratio data between the various instruments, in real time, or by comparison of note sounding ratios in real time to historical note sounding ratios, i.e. note sounding ratios that have "passed", for particular instruments, the historical note sounding ratios being temporarily stored in a suitable memory, or by comparison of note sounding ratios in real time for a particular instrument to ratio data derived independently of the musical composition 1 being analyzed and stored in a ratio memory.

The voice detection and separation systems 10, 100 or 100 of the present invention disclose novel means of accumulating music data that can be processed by means of suitable algorithms to perform virtually an infinite number of varied tasks. Various changes and modifications may be made to the preferred embodiments of the present invention without departing from the spirit and scope of the invention of this disclosure. Such changes and modifications within a fair reading of the appended claims are intended as part of the present invention.

Therefore, in view of the foregoing, I claim:

1: A sound signal analyzer for automatic detection and separation of a single voice in a complex musical composition comprising (a) waveform signal conversion means responsive to an electrical waveform signal having a frequency corresponding to the frequency of an audible sound wave for the complex musical composition for converting the electrical waveform signal to a complex frequency spectrum representation for the complex musical composition;

(b) frequency spectrum representation comparison means responsive to the complex frequency spectrum representation derived by said conversion means for comparing the complex frequency spectrum representation to predetermined steady-state, single-voice frequency spectrum representations corresponding to notes capable of being produced by a single instrument included in the complex musical composition;

(c) single-voice frequency spectrum representation detection means responsive to said frequency spectrum representation comparison means for detecting the presence of a predetermined steady-state, single-voice frequency spectrum representation corresponding to a note capable of being produced by the single instrument; and (d) frequency spectrum representation separation means responsive to the predetermined steady-state, single-voice frequency spectrum representation detected by the single-voice frequency spectrum representation detection means for separating the detected steady-state, single-voice frequency spectrum representation and respective complex frequency spectrum representations in growth and decay periods of the note corresponding to the detected frequency spectrum representation, said steady-state, growth and decay frequency spectrum representations, in combination, defining a measured waveform envelope representation.

2. A sound signal analyzer as in claim 1 further including (e) waveform envelope representation comparison means responsive to the measured waveform envelope representation for comparing the measured waveform envelope representation to predetermined single-voice waveform envelope representations corresponding to notes capable of being produced by the single instrument;

(f) waveform envelope representation detection means responsive to said waveform envelope representation comparison means for detecting the presence of a predetermined single-voice waveform envelope representation corresponding to the note depicted by the steady-state, single-voice frequency spectrum representation included in the measured waveform envelope representation; and (g) waveform envelope representation separation means responsive to the waveform envelope representation detected by the waveform envelope representation detection means for separating the detected single-voice waveform envelope representation.

3. A sound signal analyzer as in claim 2 further including data output means to output the detected single-voice waveform envelope representation as music data.

4. A sound signal analyzer as in claim 3 wherein said music data comprises audible musical sound.

5. A sound signal analyzer as in claim 3 wherein said music data comprises music notation.

6. A sound signal analyzer as in claim 3 wherein said data output means comprises, in combination, means to record the detected single-voice waveform envelope representation in a readable form and means to convert the recorded waveform envelope representation to an electrical waveform signal.

7. A sound signal analyzer as in claim 2 comprising at least two frequency spectrum representation comparison means, at least two single-voice frequency spectrum representation detection means, at least two frequency spectrum representation separation means, at least two waveform envelope representation detection means, and at least two waveform envelope representation separation means, corresponding to at least two distinct instruments in the complex musical composition.

8. A sound signal analyzer as in claim 7 further including at least two data output to output the respective detected single-voice waveform envelope representations as music data corresponding to at least two distinct instruments in the complex musical composition.

9. A sound signal analyzer as in claim 8 further including at least two filtering means disposed between respective waveform envelope representation separation means and successive frequency spectrum representation comparison means.

10. A sound signal analyzer as in claim 10 further including clock means for sequentially cuing the complex frequency spectrum representations derived by the waveform signal conversion means and filtered by said filtering means.

11. A sound signal analyzer as in claim 1 comprising at least two frequency spectrum representation comparison means, at least two single-voice frequency spectrum representation detection means, and at least two frequency spectrum representation separation means, corresponding to at least two distinct instruments in the complex musical composition.

12. A voice detection and separation system for detecting and separating a single voice in a complex musical composition comprising (i) sound wave conversion means responsive to audible sound waves of the complex musical composition for converting the sound waves into an electrical waveform signal;

(ii) amplifier means for amplifying the electrical waveform signal derived by said sound wave conversion means; and (iii) a sound signal analyzer comprising:

(a) waveform signal conversion means responsive to the amplified electrical waveform signal for converting the electrical waveform signal to a complex frequency spectrum representation for the complex musical composition, (b) frequency spectrum representation comparison means responsive to the complex frequency spectrum representation derived by said waveform signal conversion means for comparing the complex frequency spectrum representation to predetermined steady-state, single-voice frequency spectrum representations corresponding to notes capable of being produced by a single instrument included in the complex musical composition, (c) single-voice frequency spectrum representation detection means responsive to said frequency spectrum representation comparison means for detecting the presence of a predetermined steady-state, single-voice frequency spectrum representation corresponding to a note capable of being produced by the single instrument, and (d) frequency spectrum representation separation means responsive to the predetermined steady-state, single-voice frequency spectrum representation detected by the single-voice frequency spectrum representation detection means for separating the detected steady-state, single-voice frequency spectrum representation and respective complex frequency spectrum representations in growth and decay periods of the note corresponding to the detected frequency spectrum representation, said steady-state, growth and decay frequency spectrum representations, in combination, defining a measured waveform envelope representation.

13. A voice detection and separation system as in claim 12 wherein said audible sound waves are produced by a live performance of a plurality of musical instruments.

14. A voice detection and separation system as in claim 12 wherein said audible sound waves are produced by a stored performance of a plurality of musical instruments.

15. A voice detection and separation system as in claim 12 wherein said waveform signal conversion means comprises means to automatically separate fundamental and overtone frequency components of the complex musical composition and simultaneously measure the frequency and amplitude of the respective fundamental and overtone frequency components.

16. A voice detection and separation system as in claim 15 wherein said frequency spectrum representation comparison means, said single-voice frequency spectrum detection means and said frequency spectrum representation separation means comprise, in combination, a frequency spectrum comparator made operable by an algorithm providing directives to respectively compare the frequency and amplitude of said respective fundamental and overtone frequency components of the complex musical composition to fundamental and overtone frequency components of a single voice, detect the presence of said single-voice frequency components in said complex frequency components, and separate said single-voice frequency components from said complex frequency components.

17. A voice detection and separation system as in claim 15 wherein said frequency spectrum comparator includes an accumulating memory for temporary storage of frequency spectrum representations in growth and decay periods of the note corresponding to the detected frequency spectrum representation derived by said single-voice frequency spectrum representation detection means.

18. A voice detection and separation system for detecting and separating a voice in a complex musical composition comprising (i) sound wave conversion means responsive to audible sound wave of the complex musical composition for converting the sound waves into an electrical waveform signal;

(ii) amplifier means for amplifying the electrical waveform signal derived by said sound wave conversion means; and (iii) a sound signal analyzer comprising:

(a) waveform signal conversion means responsive to the amplified electrical waveform signal frequency corresponding to the frequency of an audible sound wave for the complex musical for converting the electrical waveform signal to a complex frequency spectrum representation for the complex musical composition, (b) frequency spectrum representation comparison means responsive to the complex frequency spectrum representation derived by said conversion means for comparing the complex frequency spectrum representation to predetermined steady-state, single-voice frequency spectrum representations corresponding to notes capable of being produced by a single instrument included in the complex musical composition, (c) single-voice frequency spectrum representation detection means responsive to said frequency spectrum representation comparison means for detecting the presence of a predetermined steady-state, single-voice frequency spectrum representation corresponding to a note capable of being produced by the single instrument, (d) frequency spectrum representation separation means responsive to the predetermined steady-state, single-voice frequency spectrum representation detected by the single-voice frequency spectrum representation detection means for separating the detected steady-state, single-voice frequency spectrum representation and respective complex frequency spectrum representations in growth and decay periods of the note corresponding to the detected frequency spectrum representation, said steady-state, growth and decay frequency spectrum representations, in combination, defining a measured waveform envelope representation, (e) waveform envelope representation comparison means responsive to the measured waveform envelope representation for comparing the measured waveform envelope representation to predetermined single-voice waveform envelope representations corresponding to notes capable of being produced by the single instrument, (f) waveform envelope representation detection means responsive to said waveform envelope representation comparison means for detecting the presence of a predetermined single-voice waveform envelope representation corresponding to the note depicted by the steady-state, single-voice frequency spectrum representation included in the measured waveform envelope representation, and (g) waveform envelope representation separation means responsive to the waveform envelope representation detected by the waveform envelope representation detection means for separating the detected single-voice waveform envelope representation.

19. A voice detection and separation system as in claim 18 wherein said audible sound waves are produced by a live performance of at least two musical instruments.

20. A voice detection and separation system as in claim 18 wherein said audible sound waves are produced by a stored performance of at least two musical instruments.

21. A voice detection and separation system as in claim 18 wherein said audible sound waves are produced by a live performance of at least one musical instrument in combination with a stored performance of at least one musical instrument.

22. A voice detection and separation system as in claim 18 wherein said waveform signal conversion means comprises means to automatically separate fundamental and overtone frequency components of the complex musical composition and simultaneously measure the frequency and amplitude of the respective fundamental and overtone frequency components.

23. A voice detection and separation system as in claim 22 wherein said frequency spectrum representation comparison means, said single-voice frequency spectrum detection means and said frequency spectrum representation separation means comprise, in combination, a frequency spectrum comparator made operable by an algorithm providing directives to respectively compare the frequency and amplitude of said respective fundamental and overtone frequency components of the complex musical composition to fundamental and overtone frequency components of a single voice, detect the presence of said single-voice frequency components in said complex frequency components, and separate said single-voice frequency components from said complex frequency components.

24. A voice detection and separation system as in claim 23 wherein said waveform envelope representation comparison means, said waveform envelope representation detection means and said waveform envelope representation separation means, in combination, comprise a waveform envelope comparator made operable by an algorithm providing directives to respectively compare said separated single-voice frequency components to stored transient properties of a single voice, detect the presence of said stored transient properties in said single-voice frequency components, and separate the transient properties and the frequency components of said detected single voice.

25. A voice detection and separation system as in claim 23, said sound signal analyzer further including (h) a key comparator communicating with said frequency spectrum comparator via a gate controller, said key comparator comprising key memory means for storing musical keys and associated notes, said gate controller comprising means to effect the operation of said frequency spectrum comparator in accordance to the operation of an algorithm in said key comparator providing directives to determine the key of the complex musical composition.

26. A voice detection and separation system as in claim 25 further including means to selectively program said key memory means.

27. A voice detection and separation system as in claim 25 wherein said key comparator includes means to sample the detected frequency spectrum representation in said frequency spectrum comparator and means to compare said sampled frequency spectrum representation to musical keys and associated notes stored in said key memory means.

28. A voice detection and separation system as in claim 25 wherein said gate controller includes means to shift the stored frequency spectrum representations in said frequency spectrum comparator.

29. A voice detection and separation system as in claim 25 wherein said separated single-voice frequency spectrum representation is supplied to an auxiliary device.

30. A voice detection and separation system as in claim 29 wherein said auxiliary device comprises a note transposer for transposing in real time the separated single-voice frequency spectrum representation to a note in said key memory means.

31. A voice detection and separation system as in claim 25 further including means to supply the stored musical keys and associated notes to a display device.

32. A voice detection and separation system as in claim 25 further including means to formulate subsets of said musical keys and associated notes by counting the number of times a specific note within a musical key is sounded within a particular period of time.

33. A voice detection and separation system as in claim 22 wherein said frequency spectrum comparator includes an accumulating memory for temporary storage of frequency spectrum representations in growth and decay periods of the note corresponding to the detected frequency spectrum representation derived by said single-voice frequency spectrum representation detection means.

34. A voice detecting and separation system for detecting and separating a single voice in a complex musical composition comprising (i) signal generating means for generating a composition electrical waveform signal corresponding to audible sound waves of the complex musical composition, (ii) voice detecting and separating means connected to said signal generating means for detecting a voice electrical waveform signal corresponding to a tonal structure of an individual voice in the complex musical composition and for separating the detected voice electrical waveform signal from the composition electrical waveform signal, said voice detecting and separating means detecting the voice electrical waveform signal by comparing the composition electrical waveform signal to predetermined instantaneous and transient properties of tonal structure representations for the individual voice.

35. A voice detection and separation system as in claim 34 wherein said voice detecting and separating means further detects the voice electrical waveform signal by comparing said voice electrical waveform signal properties of tonal structure representations for the individual voice determinable as a function of the key of the complex musical composition.

36. A voice detection and separation system as in claim 34 further including recording means connected to said voice detecting and separating means for recording the detected voice electrical waveform signal.

37. A voice detection and separation system as in claim 36 further including music data output means connected to said recording means for outputting the detected voice electrical waveform signal as music data.

38. A voice detection and separation system as in claim 37 wherein said music data comprises audible sounds.

39. A voice detection and separation system as in claim 37 wherein said music data comprises music notation.

40. A voice detection and separation system as in claim 34 wherein said voice detecting and separating means comprises a waveform signal converter connected to said signal generating means for converting the electrical waveform signal corresponding to a tonal structure of the complex musical composition into a frequency spectrum representation for the tonal structure of the complex musical composition;

a frequency spectrum comparator connected to said waveform signal converter for detecting and separating a frequency spectrum representation for an individual voice in the complex musical composition by comparing the frequency spectrum representation for the tonal structure of the complex musical composition with a plurality of predetermined instantaneous frequency spectrum representations for the individual voice; and a waveform envelope comparator connected to said frequency spectrum comparator for detecting and separating a waveform envelope representation for the frequency spectrum representation for the individual voice in the complex musical composition by comparing the waveform envelope representation for the individual voice with a plurality of predetermined waveform envelope representations for the individual voice.

41. A voice detection and separation system as in claim 40 wherein said plurality of predetermined instantaneous frequency spectrum representations comprise a plurality of instantaneous frequency spectrum representations corresponding to notes capable of being produced by the individual voice.

42. A voice detection and separation system as in claim 41 wherein said plurality of predetermined waveform envelope representations comprise a plurality of waveform envelope representations corresponding to the notes capable of being produced by the individual voice.

43. A voice detection and separation system as in claim 34 wherein a plurality of voice detecting and separating means are connected to said signal generating means corresponding to the plurality of voices in the complex musical composition.

44. A sound signal analyzer for detecting and separating individual voices in a composition electrical waveform signal corresponding to a tonal structure of a complex musical composition, said sound signal analyzer comprising a waveform signal converter connected to the electrical waveform signal for the tonal structure of the complex musical composition comprising means to convert the electrical waveform signal into a frequency spectrum representation for the complex musical composition;

at least one frequency spectrum comparator connected to the waveform signal converter comprising means to detect and separate a frequency spectrum representation for an individual voice in the complex musical composition; and at least one waveform envelope comparator corresponding in number to the frequency spectrum comparators and respectively connected to the frequency spectrum comparators comprising means to detect and separate a waveform envelope representation for the frequency spectrum representation for the individual voice detected and separated by the respective frequency spectrum comparators.

45. A sound signal analyzer as in claim 44 further including a clock means for sequentially queuing the frequency spectrum representations for the complex musical composition to the respective frequency spectrum comparators.

46. A sound signal analyzer as in claim 45 further including at least one filter means connected between a waveform envelope comparator and the waveform signal converter for extracting the frequency spectrum representation for the individual voice detected and separated by a frequency spectrum comparator from the frequency spectrum representation for the complex musical composition.

47. A method of detecting and separating individual voices in a complex musical composition comprising the steps of generating an electrical waveform signal corresponding to a tonal structure of the complex musical composition;

converting the electrical waveform signal into a frequency spectrum representation for the tonal structure of the complex musical composition;

comparing the frequency spectrum representation for the tonal structure of the complex musical composition to a plurality of predetermined instantaneous frequency spectrum representations for at least one individual voice;

separating a frequency spectrum representation for an individual voice from the frequency spectrum representation for the complex musical composition;

comparing the transient properties of a waveform envelope of the separated frequency spectrum representation to a plurality of predetermined waveform envelope representations for at least one individual voice; and separating the frequency spectrum representation and the transient properties of the waveform envelope for the respective individual voices.

48. A method as in claim 47 further including the step of recording the separated frequency spectrum representation and the transient properties of the waveform envelope for the individual voice as music data.

49. A method as in claim 48 further including the step of sequentially queuing the frequency spectrum representation for the complex musical composition prior to comparing the frequency spectrum representation to subsequent plurality of predetermined instantaneous frequency spectrum representation for an individual voice.

50. A method as in claim 49 further including the step of extracting the separated frequency spectrum representation for an individual voice from the frequency spectrum representation for the complex musical composition prior to comparing the frequency spectrum representation to subsequent plurality of predetermined instantaneous frequency spectrum representations for an individual voice.

51. A method for automatically detecting and separating a single voice in a complex musical composition comprising (a) converting audible sound waves of the complex musical composition to an electrical waveform signal;

(b) converting the electrical waveform signal to a complex frequency spectrum representation;

(c) comparing the complex frequency spectrum representation to predetermined steady-state, single voice frequency spectrum representations corresponding to notes capable of being produced by a single instrument of the complex musical composition;

(d) detecting the presence of a predetermined steady-state, single-voice frequency spectrum representation corresponding to a note capable of being produced by the single instrument; and (e) separating the detected frequency spectrum representation and associated complex frequency spectrum representations in the respective growth and decay periods of the note corresponding to the detected frequency spectrum representation.

52. A method as in claim 51 further comprising (f) comparing the detected frequency spectrum representation and associated complex frequency spectrum representations to predetermined waveform envelopes corresponding to notes capable of being produced by the single instrument; and (g) detecting the presence in the detected frequency spectrum representation and associated complex frequency spectrum representations of a predetermined waveform envelope corresponding to the detected note.

* * * * *